US005553603A

United States Patent [19]

Barudi et al.

[11] Patent Number: 5,553,603

[45] Date of Patent: Sep. 10, 1996

[54] AIR TO FUEL RATIO ADJUSTMENT DEVICE FOR SEALED-COMBUSTION TYPE FIREPLACES

[75] Inventors: Samir E. Barudi, Huntington Beach; John T. French, Yorba Linda; Hardial S. Gore, Buena Park, all of Calif.

[73] Assignee: Superior Fireplace Company, Fullerton, Calif.

[21] Appl. No.: 428,019

[22] Filed: Apr. 25, 1995

[51] Int. Cl.[6] ..... F24C 3/00

[52] U.S. Cl. ..... 126/512; 126/92 R; 431/354

[58] Field of Search ..... 126/512, 92 R, 126/92 AC, 85 B, 92 B; 431/354, 188, 125, 126, 355

[56] References Cited

U.S. PATENT DOCUMENTS

| | | | |
|---|---|---|---|
| 663,811 | 12/1900 | Dudgeon | 126/92 R |
| 1,281,300 | 10/1918 | Cross | 431/354 |
| 1,723,002 | 8/1929 | Bandoly et al. | 431/355 |
| 3,552,377 | 1/1971 | Hodges | 126/85 |
| 3,805,762 | 4/1974 | Nelson | 126/512 |
| 4,224,921 | 9/1980 | Petreseue | 126/121 |
| 4,271,815 | 6/1981 | Johnson | 126/121 |
| 4,779,608 | 10/1988 | Smith | 126/512 |
| 4,793,322 | 12/1988 | Shimek et al. | 126/85 B |

FOREIGN PATENT DOCUMENTS

| | | | |
|---|---|---|---|
| 699405 | 12/1964 | Canada . | |
| 1401798 | 3/1969 | Germany | 431/354 |
| 645582 | 11/1950 | United Kingdom . | |
| 823469 | 11/1959 | United Kingdom . | |
| 1044943 | 10/1966 | United Kingdom . | |
| 1044944 | 10/1966 | United Kingdom . | |
| 1044942 | 10/1966 | United Kingdom . | |

*Primary Examiner*—James C. Yeung
*Attorney, Agent, or Firm*—Christie, Parker & Hale, LLP

[57] ABSTRACT

A sealed-combustion chamber fireplace includes a combustion air to fuel adjustment device comprising an primary air-fuel mixing body having a fuel source inlet at one end and at least one combustion air inlet port disposed through a wall portion of the body. The air-fuel mixture body may be configured in the form of an air-fuel venturi, burner tube and the like to effect mixing together of the air and fuel to form a combustible air-fuel mixture. An air inlet port cover is movably disposed adjacent the air-fuel mixing body and forms an adjustable air combustion aperture by placement of the cover adjacent the air inlet port. Movement of the cover about the body effects opening or closing of the aperture, thereby effecting adjustment of the primary air to fuel ratio of the air-fuel mixture combusted in the combustion chamber. A cover arm is attached to the cover and an actuator arm is movably attached to the cover arm to facilitate adjustment of the aperture, thereby, permitting adjustment of the flame appearance during operation of the fireplace from a position outside of the fireplace.

38 Claims, 3 Drawing Sheets

AIR TO FUEL RATIO ADJUSTMENT DEVICE FOR SEALED-COMBUSTION TYPE FIREPLACES

FIELD OF THE INVENTION

The present invention relates generally to a sealed-combustion type fireplace and other heaters and, more particularly, to a sealed-combustion type fireplace comprising a combustion air to fuel ratio adjustment device.

BACKGROUND OF THE INVENTION

A direct-vented or sealed-combustion fireplace is characterized as a fireplace having a fresh air duct and an exhaust duct that are each routed from a combustion chamber of the fireplace to a position outside of a building or dwelling in which the fireplace is located, e.g., through an outside wall. Combustion air needed to burn fuel is routed from the fresh air duct to the combustion chamber by a fresh air plenum inside of the fireplace. In a conventional sealed-combustion fireplace, the part of combustion air (primary air) entering the fireplace via the fresh air plenum is mixed with the fuel source within an air-fuel mixing body such as a venturi or burner tube disposed within the combustion chamber of the fireplace. The air-fuel mixing body is configured having a fuel source inlet to accommodate connection with and accept fuel output from a fuel source feed line.

The sealed-combustion fireplace is operated by opening a valve or the like disposed within the fuel source feed line, causing the fuel to be dispensed into and be distributed the air-fuel mixing body. Primary air from the fresh air plenum is allowed to enter the burner tube via one or more openings in the mixing body or in an air-fuel burner system connected to the mixing body. The combustion air mixes with the fuel to form a combustible mixture that is ignited by an ignition source to form a flame that projects from the air-fuel burner system into the fireplace via openings in the burner system.

The exhaust gases produced as a result of the combustion rise from the combustion chamber and are routed within the fireplace to the exhaust gas plenum duct and out the exhaust gas duct. In this manner the exhaust gases produced by the combustion within the fireplace are swept from the fireplace to the outside environment and, therefore, are prevented from entering the room where the fireplace is located. Accordingly, sealed-combustion fireplaces have the advantage of heating an interior space, i.e., a room, by thermal convection and radiation without emitting combustion product gases into the interior space and without requiring the use of room air that has been heated. This allows for more efficient use of fireplaces. Such fireplaces are commonly used to heat interior spaces within structures where conventional open-combustion type fireplaces, i.e., fireplaces having a chimney built integrally within the wall and which depend on combustion air from the interior environment, have not or could not be installed. They are more efficient than open combustion type fireplaces.

During the operation of a sealed-combustion type fireplace it is desired that the flame produced as a result of combustion of the air-fuel mixture be similar in appearance to the flame produced in a conventional wood-burning fireplace. However, a consistent flame appearance is difficult to achieve because the physical properties, i.e., heating value (BTU), specific gravity, adiabatic flame temperature, etc., and the composition of the fuel source can vary from region to region and/or from supplier to supplier. Additionally, the vent configuration, prevalent Wind conditions, outside air temperature, and temperature of air entering the fireplace may also affect the flame appearance. Therefore, the ability to adjust the proportion of combustion air to fuel prior to combustion is important for purposes of obtaining and/or maintaining an attractive flame and optimum combustion.

Sealed-combustion type fireplaces incorporating devices that allow a user to adjust the proportion of combustion air to fuel ratio to effect the adjustment of the flame within the fireplace are known. However, such sealed-combustion type fireplaces do not permit access for adjustment of the air to fuel ratio while the fireplace is in operation. Rather, they only permit adjustment after the fireplace has been shut off and has cooled. After an adjustment has been made, the effect of the change cannot be seen until the unit has been in operation for about 15 to 30 minutes.

It is, therefore, desirable that a sealed-combustion type fireplace include a mechanism for adjustment of the combustion air to fuel ratio during use, thereby allowing a user to adjust the flame resulting from combustion of such air to fuel mixture. It is desirable that the air to fuel ratio adjusting mechanism be simple to operate and capable of being operated from a position remote from the combustion chamber during use of the fireplace. It is desirable that the adjustment mechanism be constructed in a manner that does not compromise the sealed-combustion feature of the fireplace. It is also desirable that the adjustment mechanism be manufactured from conventional manufacturing techniques and materials.

SUMMARY OF THE INVENTION

This invention provides a sealed-combustion chamber fireplace or other sealed combustion heater, comprising a combustion air to fuel adjustment device. As used herein the term "sealed combustion heater" includes sealed combustion fireplaces having one or more glass panels enabling viewing of the flames. The device includes an air-fuel mixing body having a fuel source inlet at one end for accommodating connection with a fuel source such as natural gas. The mixing body includes at least one combustion air inlet port disposed through a wall of the body. The air-fuel mixture body may be an air-fuel venturi to effect mixing of the air-fuel mixture and transportation of the mixture to an air-fuel burner system for dispensement, or may be a burner tube to effect both the mixing of the air-fuel mixture and dispensement of the combustion mixture for combustion within the fireplace.

The adjustment device has a means for adjusting the ratio of air to fuel entering and passing through the air-fuel mixing body. Means are also provided for actuating the adjusting means by a user during operation of the fireplace from a position outside of the sealed combustion chamber.

A preferred adjusting means comprises an air inlet port cover movably disposed adjacent the air-fuel mixing body. An adjustable air combustion aperture is formed by placement of a portion of the cover adjacent the air inlet port. Movement of the cover about the body in one direction causes the air aperture to close while movement of the cover in an opposite direction causes the air aperture to open. Adjustment of the combustion air to fuel ratio of the air-fuel mixture combusted in the fireplace is achieved by opening and closing the air aperture. The device includes a cover arm attached at one end to the cover, and an actuator arm movably attached to an opposite end of the cover arm to facilitate adjustment of the combustion air aperture, i.e., adjustment of the air to fuel ratio, during operation of the fireplace or heater from a position outside of the sealed combustion chamber.

The air to fuel adjustment device constructed according to principles of this invention allows for adjustment of the air to fuel ratio for a sealed-combustion type fireplace or heater. This permits adjustment of the flame appearance i.e., flame color and height, a characteristic important in gas fireplaces, as well as combustion characteristics. The air to fuel adjustment device allows a desired combustion characteristic, to be maintained in spite of variations in the type and/or composition of the fuel source used to fuel the fireplace; therefore, allowing such fireplaces to be used safely and efficiently under a greater variety of conditions.

BRIEF DESCRIPTION OF THE DRAWINGS

These and other aspects and advantages of the present invention will become appreciated as the same becomes better understood with reference to the specification, claims and drawings wherein:

DETAILED DESCRIPTION

Figure 1:
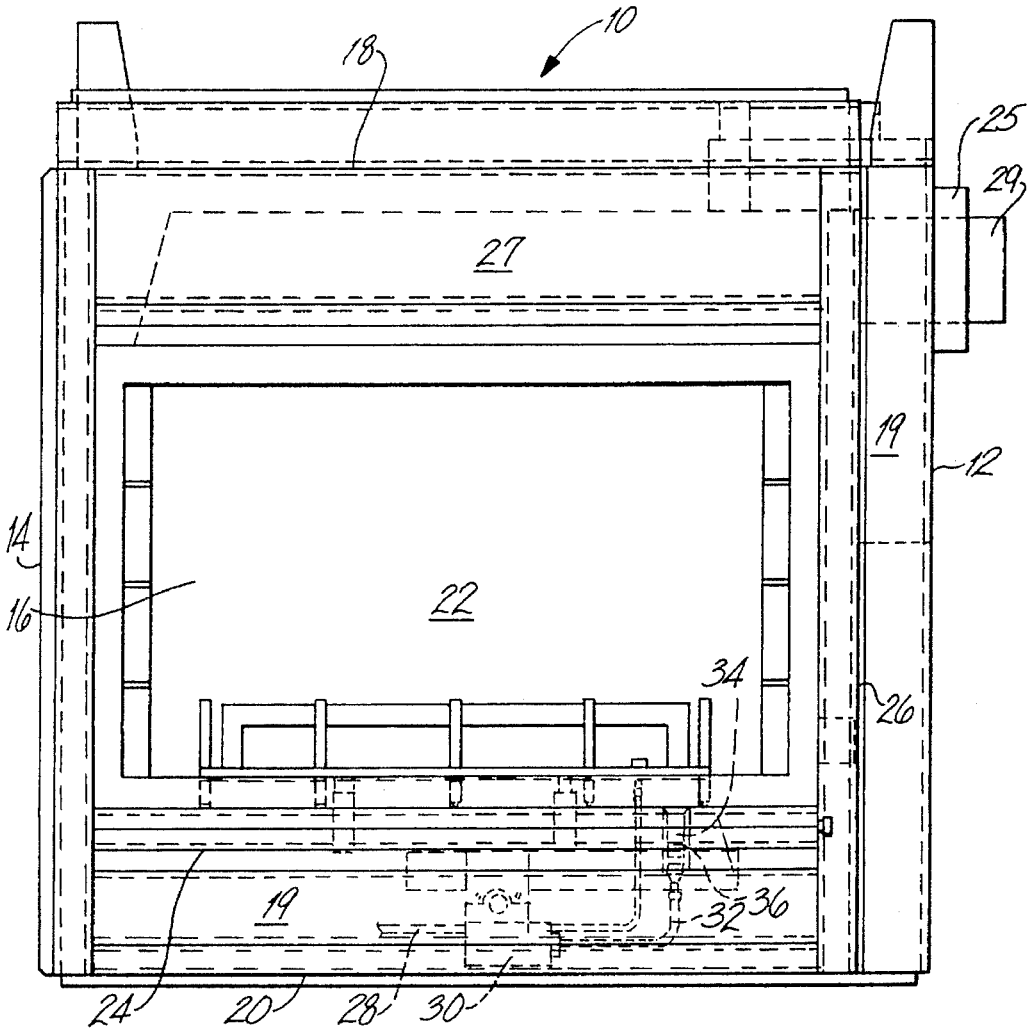
FIG. 1 is a front view of a sealed-type combustion fireplace comprising a combustion air to fuel ratio adjustment device as constructed according to principles of this invention.

FIG. 1 illustrates a sealed-combustion type fireplace or heater comprising a combustion air to fuel ratio adjustment device constructed according to principles of this invention. It is to be understood that the fireplace in FIG. 1 is provided for purposes of reference and illustration only and is, therefore, not intended to limit the application of the air to fuel ratio adjustment mechanism to any particular type of sealed combustion fireplace or heater.

The fireplace 10 comprises four vertical walls comprising two side walls 12 and 14, a back wall 16, and a front wall (not shown), wherein the front wall is formed from a sheet of glass. The fireplace also has a top wall 18 and a bottom wall 20, thereby forming a completely enclosed combustion chamber 22 therein. The fireplace includes a fresh air plenum 19 that is formed between the bottom and side walls 20 and 12 and a first and second baffle 24 and 26. The fresh air plenum 19 is connected to a fresh air duct 25 which extends outwardly and away from the fireplace through an interior wall, or the like, of the home or structure adjacent the fireplace to provide combustion air from the outside environment. It is understood that the fresh air duct may extend horizontally, vertically or any suitable angle from the fireplaces.

An exhaust gas plenum 27 extends from a top portion of the combustion chamber 22 and is connected to an exhaust gas duct 29 that also passes through the interior wall of the home or structure to facilitate the passage of combustion gases from the fireplace to the outdoor environment.

The fireplace is configured to burn a hydrocarbon fuel source such as natural gas or propane gas. The fuel is routed into a portion of the fresh air plenum 19 positioned between the bottom wall 20 and the first baffle 24 via flexible or hard piping 28. The fuel source piping 28 connects to a fuel source valve 30 that is also disposed within the fresh air plenum 19. The fuel source valve 30 can be of conventional design and operable either manually or electrically, and can also include an ignitor or pilot system for effecting combustion of the air-fuel mixture to provide the fireplace flame.

The fuel exits valve 30 via tubing 32 that is configured to accommodate attachment at an end portion with an air-fuel mixing body 34. The air-fuel mixing body 34, which can have a number of different configurations, serves to mix the fuel exiting the tubing 32 with combustion or primary air provided from the fresh air plenum 19 to form a combustible air-fuel mixture. The mixing body 34 is constructed according to principles of this invention having an adjustable combustion air aperture 36 formed therein as described in greater detail below.

Figure 2:
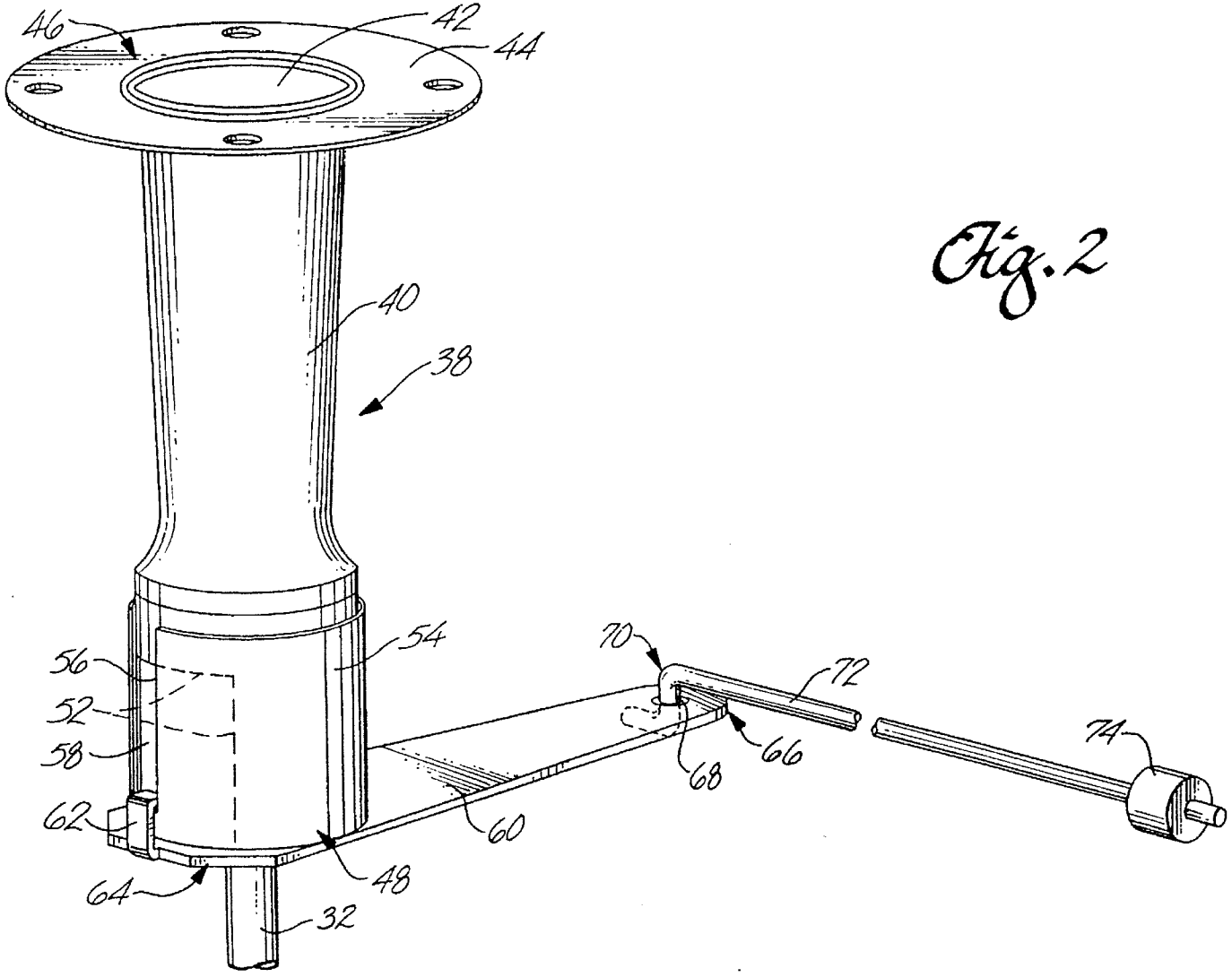
FIG. 2 is a perspective view of a first preferred embodiment of a combustion air to fuel ratio adjustment device.

FIG. 2 illustrates a first preferred embodiment of a combustion air to fuel ratio adjustment device, for use in a sealed-combustion type fireplace constructed according to principles of this invention, comprising an air-fuel mixing body 38 configured in the form of an air-fuel venturi. The venturi 38 has a generally cylindrical body 40 with an annular interior passage 42 that extends therethrough. It is to be understood that although the venturi body for the first preferred embodiment has been configured having a generally cylindrical shape, i.e., having a circular cross section, a venturi body configured having other geometrically shaped cross sections is possible and such sections are, therefore, intended to be within the scope of this invention.

The venturi 38 includes an attachment fitting 44 at one end portion 46 of the venturi body 40. The attachment fitting is in the form of a flange-type fitting to accommodate attachment with an air-fuel burner system (not shown) disposed within the combustion chamber of the fireplace. Typically, the air-fuel burner system comprises air-fuel distribution piping or tubing that distributes the air-fuel combustion mixture provided from the venturi and dispenses it adjacent a bottom portion of ceramic logs, rocks and the like that are placed within the combustion chamber.

The venturi 38 includes a fuel source inlet (not shown) at an opposite end 48 of the venturi body 40 to accommodate connection with fuel source piping 50. At least one combustion air inlet port 52 extends through a wall portion of the venturi body 40. The air inlet port 52 extends from the end 48 of the venturi body 40 a distance toward the attachment fitting 44. In a first preferred embodiment, the air inlet port 52 is a single opening preferably in the shape of a rectangle. It is to be understood that the venturi 38 may comprise more than one air inlet port, and may comprise an air-inlet port that is configured having a geometric shape other than a rectangle.

An air shutter or cover 54 is partially disposed concentrically or circumferentially around the venturi body 40 at end 48. The air shutter 54 has an open or slotted portion 56 that is of the same or smaller dimension as that of the air inlet port 52. Alternatively, the air shutter can be a single flap that extends along the venturi body and that is positioned over the air inlet port, thereby eliminating a need for a slot. The air shutter 54 is slidably disposed around the venturi body 40 so that rotation of the air shutter in one direction closes a combustion air aperture 58 the size of which is determined by placement of the shutter 54 over the inlet port 52, and rotation of the shutter in an opposite direction opens the combustion air aperture 58.

An air shutter arm or cover arm 60 is attached at one end to the air shutter 54 and is positioned adjacent the end 48 of the venturi body 40. Piping 50 forms an axis of rotation for arm 60. The arm 60 is used to facilitate rotatable movement of the air shutter 54 about the venturi body. In a particularly preferred embodiment, the shutter arm has a generally rectangular configuration with rounded off corners. The shutter arm 60 includes a central opening (not shown) to accommodate placement of the fuel source piping 32 therethrough. The shutter includes a limiter 62 that extends from an end portion 64 of the shutter arm adjacent the venturi body 40 a predetermined distance into the air inlet port 52. The limiter 62, which is preferably integrally formed with the arm, serves to prevent the air shutter 54 from being rotated about the venturi body 40 in a manner that completely covers the air inlet port 52, thereby preventing the air aperture 58 from being completely closed. The limiter acts to prevent complete aperture closure by engaging edges of the housing 40 forming the air inlet port 52. If desired, the limiter can, alternatively, be formed as an integral portion of the venturi body 40.

The shutter arm 60 has an end portion 66 opposite from end portion 64 that includes ,a fitting 68 to accommodate movable attachment with an end portion 70 of an actuator arm 72. In a particularly preferred embodiment, the fitting 68 is in the form of a hole extending through the shutter arm. The actuator arm 72 can be formed from a length of metal rod and the like that extends through a wall portion of the fireplace into a room to facilitate movement of the air shutter 54, i.e., adjustment of the combustion air aperture 58, from a position outside of the fireplace. Alternatively, the actuator arm 72 can be formed from cable, chain or the like. The actuator arm 72 extends through an air-tight fitting 74 placed within the fireplace wall that ensures that indoor air does not enter the fresh air plenum of the fireplace. The actuator arm preferably has a handle and the like at the end portion that extends from the fireplace to facilitate easy gripping and operation by a user seeking to adjust the size of the combustion air aperture 58.

The air-fuel venturi 38 is attached at end 48 to the first baffle or other stationary member within the fireplace (See FIG. 1) so that transverse movement of the actuator arm 72 causes the shutter arm 60 and air shutter 54 to rotate around the venturi body 40 and effect opening and closing of the combustion air aperture 58. Accordingly, the air-fuel venturi constructed according to principles of this invention allows a user to adjust the primary combustion air to fuel ratio in a sealed-combustion type fireplace from a position outside of the sealed fireplace to account for variations in the type and composition of the fuel source and variations in vent configurations and installations.

Figure 3:
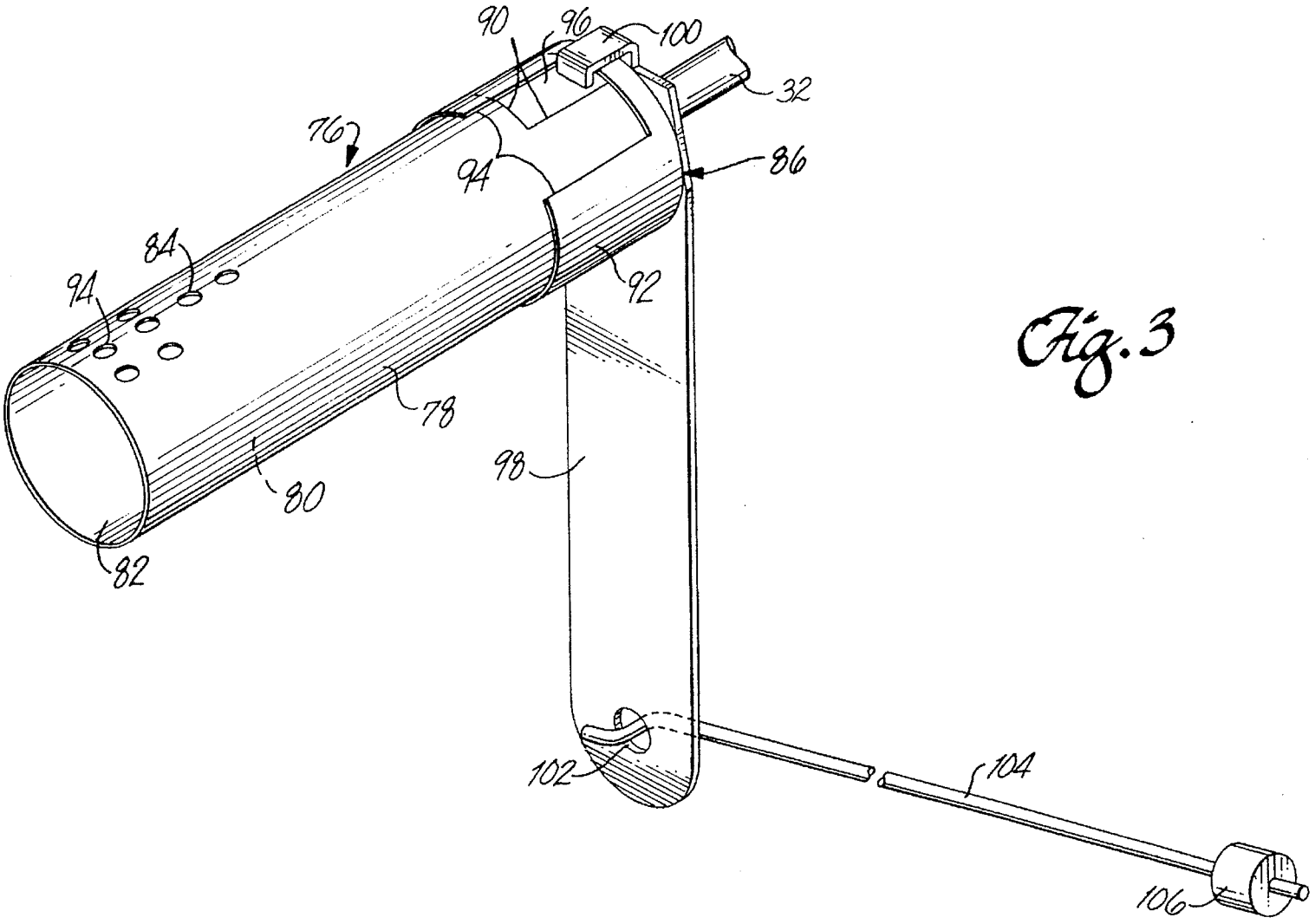
FIG. 3 is a perspective view of a second preferred embodiment of a combustion air to fuel ratio adjustment device.

FIG. 3 illustrates a second preferred embodiment of a combustion air to fuel ratio adjustment device constructed according to principles of this invention for use with a sealed-combustion chamber fireplace. The device comprises an air-fuel mixing body 76 in the form of a burner tube. The burner tube 76 has a generally cylindrical body 78 and an annular interior passageway 80 that extends therethrough. The burner tube has a closed end 82 at one end of the body 78 and a plurality of openings 84 that extend through a wall portion of the body. In a particularly preferred embodiment, the openings are positioned along a topmost portion of the burner tube body 78 to facilitate dispensement of an air-fuel combustion mixture onto a ceramic log (not shown) and the like that is placed on top of the burner tube. The burner tube 76 includes a fuel source inlet (not shown) at an end 86 of the burner tube body 78 opposite from the closed end 82 to accommodate connection with fuel source piping 32, thereby allowing fuel routed from the fuel source valve (see FIG. 1) to be dispensed within the interior passage 80 of the burner tube.

At least one combustion air inlet port 90 extends through a wall portion of the burner tube body 78. The air inlet port 90 extends from the end 86 of the burner tube body a distance toward the closed end 82. In a particularly preferred embodiment, the air inlet port 90 comprises a single opening in the shape of a rectangle.

Like the first preferred embodiment, an air shutter or cover 92 is partially disposed concentrically or circumferentially around the burner tube body 78 at end 86. The air shutter 92 has an open or slotted portion 94 that is of equal or smaller dimension as that of the air inlet port 90. The shutter 92 is slidably disposed around the body 78 so that rotation of the air shutter in one direction decreases the size of a combustion air aperture 96, formed by the position of the air shutter over the air inlet port, and rotation in an opposite direction increases the size of the aperture 96.

In this embodiment, an air shutter arm or cover arm 98 has a limiter 100 and an attachment fitting 102, and an actuator arm 104 has an air-tight fitting 106 which all connect and function in the same manner as that described above and illustrated in FIG. 2 for the first preferred embodiment, i.e., to facilitate adjustment of the combustion air aperture 96 from a position outside of the fireplace. The piping 88 forms an axis of rotation for the arm 98.

The burner tube 78 is different from the venturi embodiment of the invention in that the burner tube does not require connection with a separate air-fuel burner system because the burner tube serves to both create a combustion air-fuel mixture of desired proportion and distribute the air-fuel mixture for combustion within the combustion chamber. The combustion air-fuel mixture that is distributed through the burner tube is dispensed along the length of the tube via the openings 84 and is ignited to form a desired flame within the combustion chamber of the fireplace.

The burner tube 76 is attached at end 86 to a stationary member within the fireplace such as a baffle so that transverse movement of the actuator arm 104 by a user causes the shutter arm 98 and air shutter 92 to rotate around the burner tube body 78 and effect the opening and closing of the combustion air aperture 96. Accordingly, the burner tube constructed according to principles of this invention allows a user to adjust the combustion air to fuel ratio in a sealed-combustion type fireplace during operation of the fireplace from a position outside of the fireplace to provide a desired flame appearance. The ability to adjust the air to fuel ratio during operation of the fireplace permits a user to adjust and maintain a flame appearance to simulate a flame produced by the combustion of wood, rather than a hydrocarbon fuel source, in light of variations in fuel source composition and/or types. The device allows the user to adjust the flame appearance quickly, without having to shut the fireplace off and wait for the fireplace to cool before making such adjustment. The ability to adjust the flame appearance during operation of the fireplace from a position outside of the fireplace also permits safe adjustment of the flame appearance, because such adjustment is made without having to contact a hot fireplace member.

It is desired that the first and second preferred embodiments of the combustion air to fuel ratio adjustment device be formed from a structurally strong and fire resistant material such as steel or steel alloy.

It is understood that the adjustable in-fuel mixing body is usable in any sealed combustion fireplaces or heater. That is, the number, size and shape of plenum in the fireplace or heater may vary as desired as well as the size, shape and direction of exhaust and fresh air ducts.

Although only two embodiments of the combustion air to fuel ratio adjustment device for a sealed-combustion type fireplace or heater have been described herein, many modifications and variations will be apparent to those skilled in the art. For example, it is apparent that electronic or other mechanical means for actuating the adjusting means from a position outside of the fireplace may be used rather than the specific mechanism described above. Accordingly, it is to be understood that the combustion air to fuel ratio adjustment devices constructed according to principles of this invention may be embodied other than as specifically described herein and thus are measured by the appended claims, not the disclosure.

What is claimed is:

1. A sealed-combustion chamber fireplace comprising:

(a) a sealed housing;

(b) a combustion chamber within the sealed housing; and (c) a combustion air-to-fuel ratio adjustment means which comprises:

(i) an air-fuel mixing body within the sealed housing including a fuel source inlet, and at least one combustion air inlet port; and (ii) air adjusting means within the sealed housing for adjusting the amount of air entering the air-fuel mixing body, said air adjusting means being operable independently from any means for adjusting the amount of fuel entering the air-fuel mixing body; and (iii) means, outside of the sealed housing, for operating the air adjusting means by a user during operation of the fireplace.

2. A sealed-combustion fireplace as recited in claim 1 wherein the means for adjusting the amount of air comprises an air inlet port cover disposed adjacent the air-fuel mixing body for adjustably covering the inlet port to define an air aperture, and wherein movement of the actuating means adjusts the cover relative to the inlet port for selectively closing and opening the aperture a desired amount.

3. A sealed-combustion fireplace as recited in claim 2 comprising means for preventing the combustion aperture from being completely closed.

4. A sealed-combustion fireplace as recited in claim 3 wherein the means for preventing complete closure of the combustion aperture comprises an aperture limiter that extends a distance into the air inlet opening to prevent the cover from being moved completely over the opening.

5. A sealed-combustion fireplace as recited in claim 2 wherein the air inlet port cover is disposed circumferentially around an outside surface of the air-fuel mixing body and comprises at least one opening, and wherein the opening corresponds in size and placement to the air inlet port.

6. A sealed-combustion fireplace as recited in claim 1 wherein the actuating means comprises an arm attached to the inlet port cover, wherein movement of the arm effects rotational movement of the cover relative to the body and air inlet port.

7. A sealed-combustion fireplace as recited in claim 6 wherein the actuating means further comprises an actuator lever attached at one end to an end portion of the arm, wherein an opposite end of the actuator lever extends through the sealed housing to permit operation of the actuating means from outside of the sealed housing.

8. A sealed-combustion fireplace as recited in claim 1 wherein the air-fuel mixing body comprises a burner tube having a closed end opposite from the fuel source inlet, and having a plurality of openings extending through a wall portion of the mixing body.

9. A sealed-combustion chamber fireplace comprising:

(a) a sealed housing;

(b) A combustion chamber within the housing;

(c) a combustion air to fuel ratio adjustment device including:

(i) an air-fuel mixing body within the sealed housing having a fuel source inlet at one end, and at least one combustion air inlet port extending through a wall portion of the body;

(ii) an air inlet port cover disposed concentrically around an outside surface of the air-fuel mixing body, wherein a combustion air aperture is defined by a position of the cover over the inlet port, and wherein movement of the cover relative to the inlet port effects closing and opening of the aperture; and (iii) means for adjusting the position of the cover to adjust the size of the combustion air aperture from a position outside of the sealed housing.

10. A sealed-combustion fireplace as recited in claim 9 wherein the means for adjusting the size of the combustion air aperture includes an actuator having an arm attached to the air inlet port cover, wherein transverse movement of the arm effects rotational movement of the cover about the air-fuel mixing body.

11. A sealed-combustion fireplace as recited in claim 10 comprising an actuator lever attached to the arm and extending through the fireplace from the arm to a position outside of the fireplace housing.

12. A sealed-combustion heater as recited in claim 10 comprising an aperture limiter attached to the arm, wherein the aperture limiter extends a distance into the inlet air port and prevents the combustion air aperture from being completely closed.

13. A sealed-combustion fireplace as recited in claim 10 wherein the air inlet cover comprises at least one opening that corresponds in size and configuration to the air inlet port so that alignment of the opening with the air inlet port places the combustion air aperture in a maximum open position.

14. A sealed-combustion fireplace as recited in claim 10 wherein the air-fuel mixing body is an air-fuel venturi configured to effect mixing together of combustion air and fuel upstream from an air-fuel burner system.

15. A sealed-combustion fireplace as recited in claim 10 wherein the air-fuel mixing body is a burner tube configured to effect mixing together and dispensement of combustion air and fuel, and wherein the burner tube comprises:

a closed end at one end of a burner tube body opposite from the fuel source inlet; and a number of openings disposed through a wall portion of the burner tube body, wherein mixed combustion air and fuel is distributed through the burner tube and dispensed from the tube via the openings for combustion to form a flame within the fireplace.

16. A sealed-combustion chamber fireplace comprising:

(a) a sealed housing;

(b) a combustion chamber within the sealed housing;

(c) an air to fuel adjustment device comprising:

(i) an air-fuel mixing body within the sealed housing having an annular passage extending therethrough, the mixture body comprising:

a fuel source inlet at one end of the body to accommodate connection with a fuel source; and at least one combustion air inlet port disposed through a wall portion of the body, wherein the air inlet port is positioned adjacent the fuel source inlet; and (ii) an air inlet port cover disposed concentrically around an outside surface of the air-fuel mixing body adjacent the air inlet port and movable with respect to the body, wherein placement of the cover over and with respect to the air inlet defines a combustion air aperture, wherein movement of the cover around the body in one direction increases the size of the air aperture, and movement of the cover around the body in an opposite direction decreases the size of the air aperture; and (iii) means attached to the cover for permitting adjustment of the aperture from outside of the sealed housing.

17. A sealed-combustion fireplace as recited in claim 16 wherein the means for permitting adjustment of the aperture includes an actuator comprising:

a arm attached at one end to the cover and extending a distance away from the cover; and an actuator lever that is movably attached to an opposite end of the arm, wherein the lever passes through a wall portion of the fireplace to a position outside of the sealed housing.

18. A sealed-combustion fireplace as recited in claim 16 wherein the air-fuel mixing body comprises an air-fuel venturi attached to an air-fuel burner system at an end opposite the fuel source inlet.

19. A sealed-combustion fireplace as recited in claim 16 wherein the air fuel mixing body comprises a burner tube comprising:

a closed end opposite the fuel source inlet; and a plurality of openings extending through a wall portion of the burner tube, wherein mixed combustion air and fuel is dispensed from the burner tube through the openings and is combusted to form a flame within the combustion chamber.

20. A sealed-combustion chamber heater comprising:

(a) a sealed housing;

(b) a combustion chamber within the sealed housing; and (c) a combustion air-to-fuel ratio adjustment means which comprises:

(i) an air-fuel mixing body within the sealed housing including a fuel source inlet, and at least one combustion air inlet port; and (ii) air adjusting means within the sealed housing for adjusting the amount of air entering the air-fuel mixing body, said air adjusting means being operable independently from any means for adjusting the amount of fuel entering the air-fuel mixing body; and (iii) means, outside of the sealed housing, for operating the air adjusting means by a user during operation of the heater.

21. A sealed-combustion heater as recited in claim 20 wherein the means for adjusting the amount of air comprises an air inlet port cover disposed adjacent the air-fuel mixing body for adjustably covering the inlet port to define an air aperture, and wherein movement of the actuating means adjusts the cover relative to the inlet port for selectively closing and opening the aperture a desired amount.

22. A sealed-combustion heater as recited in claim 21 wherein the actuating means comprises an arm attached to the inlet port cover, wherein movement of the arm effects rotational movement of the cover relative to the body and air inlet port.

23. A sealed-combustion heater as recited in claim 22 wherein the actuating means further comprises an actuator lever attached at one end to an end portion of the arm, wherein an opposite end of the actuator lever extends through the sealed housing to permit operation of the actuating means from outside of the sealed housing.

24. A sealed-combustion heater as recited in claim 21 comprising means for preventing the combustion aperture from being completely closed.

25. A sealed-combustion heater as recited in claim 24 wherein the means for preventing complete closure of the combustion aperture comprises an aperture limiter that extends a distance into the air inlet opening to prevent the cover from being moved completely over the opening.

26. A sealed-combustion heater as recited in claim 21 wherein the air inlet port cover is disposed circumferentially around an outside surface of the air-fuel mixing body and comprises at least one opening, and wherein the opening corresponds in size and placement to the air inlet port.

27. A sealed-combustion heater as recited in claim 20 wherein the air-fuel mixing body comprises a burner tube having a closed end opposite from the fuel source inlet, and having a plurality of openings extending through a wall portion of the mixing body.

28. A sealed-combustion chamber heater comprising:

(a) a sealed housing;

(b) a combustion chamber within the sealed housing;

(c) a combustion air to fuel ratio adjustment device including:

(i) an air-fuel mixing body within the sealed housing having a fuel source inlet at one end, and at least one combustion air inlet port extending through a wall portion of the body;

(ii) an air inlet port cover disposed concentrically around an outside surface of the air-fuel mixing body, wherein a combustion air aperture is defined by a position of the cover over the inlet port, and wherein movement of the cover relative to the inlet port effects closing and opening of the aperture; and (iii) means for adjusting the position of the cover to adjust the size of the combustion air aperture from a position outside of the sealed housing.

29. A sealed-combustion heater as recited in claim 28 wherein the means for adjusting the size of the combustion air aperture includes an actuator having an arm attached to the air inlet port cover, wherein transverse movement of the arm effects rotational movement of the cover about the air-fuel mixing body.

30. A sealed-combustion heater as recited in claim 29 comprising an actuator lever attached to the arm and extending to a position outside of the sealed housing.

31. A sealed-combustion heater as recited in claim 29 comprising an aperture limiter attached to the arm, wherein the aperture limiter extends a distance into the inlet air port and prevents the combustion air aperture from being completely closed.

32. A sealed-combustion heater as recited in claim 29 wherein the air inlet cover comprises at least one opening that corresponds in size and configuration to the air inlet port so that alignment of the opening with the air inlet port places the combustion air aperture in a maximum open position.

33. A sealed-combustion heater as recited in claim 29 wherein the air-fuel mixing body is an air-fuel venturi configured to effect mixing together of combustion air and fuel upstream from an air-fuel burner system.

34. A sealed-combustion heater as recited in claim 29 wherein the air-fuel mixing body is a burner tube configured to effect mixing together and dispensement of combustion air and fuel, and wherein the burner tube comprises:

a closed end at one end of a burner tube body opposite from the fuel source inlet; and a number of openings disposed through a wall portion of the burner tube body, wherein mixed combustion air and fuel is distributed through the burner tube and dispensed from the tube via the openings for combustion to form a flame within the combustion chamber.

35. A sealed-combustion heater comprising:

(a) a sealed housing (b) a combustion chamber within the sealed housing;

(c) an air to fuel adjustment device comprising:

(i) an air-fuel mixing body within the sealed housing having an annular passage extending therethrough, the mixture body comprising:

a fuel source inlet at one end of the body to accommodate connection with a fuel source; and at least one combustion air inlet port disposed through a wall portion of the body, wherein the air inlet port is positioned adjacent the fuel source inlet;

(ii) an air inlet port cover disposed concentrically around an outside surface of the air-fuel mixing body adjacent the air inlet port and movable with respect to the body, wherein placement of the cover over and with respect to the air inlet defines a combustion air aperture, wherein movement of the cover around the body in one direction increases the size of the air aperture, and movement of the cover around the body in an opposite direction decreases the size of the air aperture; and (iii) means attached to the cover for permitting adjustments of the aperture from outside of the sealed housing.

36. A sealed-combustion heater as recited in claim 35 wherein the means for permitting adjustment of the aperture includes an actuator comprising:

a arm attached at one end to the cover and extending a distance away from the cover; and an actuator lever that is movably attached to an opposite end of the arm, wherein the lever passes through a wall portion of the sealed housing to a position outside of the sealed housing.

37. A sealed-combustion heater as recited in claim 35 wherein the air-fuel mixing body comprises an air-fuel venturi attached to an air-fuel burner system at an end opposite the fuel source inlet.

38. A sealed-combustion heater as recited in claim 35 wherein the air fuel mixing body comprises a burner tube comprising:

a closed end opposite the fuel source inlet; and a plurality of openings extending through a wall portion of the burner tube, wherein mixed combustion air and fuel is dispensed from the burner tube through the openings and is combusted to form a flame within the combustion chamber.

* * * * *